United States Patent [19]

Lacroix et al.

[11] Patent Number: 4,909,153

[45] Date of Patent: Mar. 20, 1990

[54] TRANSPORT SYSTEMS USING PASSIVE VEHICLES

[75] Inventors: Serge Lacroix, Chalons; Marc P. Treviso, Reims, both of France

[73] Assignee: Critt Productique, Chalons, France

[21] Appl. No.: 163,970

[22] PCT Filed: Jun. 4, 1987

[86] PCT No.: PCT/FR87/00200

§ 371 Date: Feb. 5, 1988

§ 102(e) Date: Feb. 5, 1988

[87] PCT Pub. No.: WO87/07572

PCT Pub. Date: Dec. 17, 1987

[30] Foreign Application Priority Data

Jun. 5, 1986 [FR] France ..... 86 08092

[51] Int. Cl.[4] ..... B61B 13/12

[52] U.S. Cl. ..... 104/166; 105/341

[58] Field of Search ..... 104/165, 166, 242–248; 105/341

[56] References Cited

U.S. PATENT DOCUMENTS

| | | | |
|---|---|---|---|
| 3,356,040 | 12/1967 | Fonden | 104/130 |
| 3,467,026 | 9/1969 | Broggie et al. | 105/341 |
| 3,628,766 | 12/1971 | Hartmann | 104/246 X |
| 3,818,837 | 6/1974 | Jacoby et al. | 104/166 |
| 3,842,752 | 9/1974 | Harwick | 104/166 |
| 4,036,148 | 7/1977 | Jones et al. | 104/166 |
| 4,347,792 | 9/1982 | Nagahori | 104/166 |
| 4,358,999 | 11/1982 | Nagahori | 104/166 |
| 4,367,683 | 1/1983 | Tokunaga | 104/166 |
| 4,378,741 | 4/1983 | Nagahari | 104/18 |
| 4,416,456 | 11/1983 | Knight | 104/244 X |
| 4,429,636 | 2/1984 | Ziegenfus | 104/166 X |
| 4,603,639 | 8/1986 | Sleep | 104/166 X |
| 4,603,720 | 8/1986 | Jacoby | 104/166 X |
| 4,620,280 | 10/1986 | Conklin | 104/166 X |
| 4,648,325 | 3/1987 | Gutekunst et al. | 104/166 |
| 4,696,236 | 9/1987 | Kanayama | 104/165 |
| 4,718,350 | 1/1988 | Jacoby et al. | 104/166 |

FOREIGN PATENT DOCUMENTS

| | | |
|---|---|---|
| 663584 | 9/1965 | Belgium . |
| 2033665 | 12/1970 | France . |
| 207979 | 1/1924 | United Kingdom . |
| 2067488 | 7/1981 | United Kingdom . |
| 2067489 | 7/1981 | United Kingdom . |
| 2067964 | 8/1981 | United Kingdom . |
| 2068316 | 8/1981 | United Kingdom . |
| 2068864 | 8/1981 | United Kingdom . |

*Primary Examiner*—Margaret A. Focarino
*Assistant Examiner*—Joseph D. Pape
*Attorney, Agent, or Firm*—Cushman, Darby & Cushman

[57] ABSTRACT

The invention concerns a variable speed transportation system using passive vehicles. The passive vehicles (1) are driven at variable speed by tubes (4) rotating in bearings (13) mounted on cross-bars (14) supporting the rails (2 and 3) and by rollers rolling on the tubes (4) and orientable through an articulated parallelogram linkage (7) actuated by a lever (8) and a manoeuvring sprocket wheel (9) controlled by cams situated at the edge of the track or at the rear of the preceding vehicle.

12 Claims, 8 Drawing Sheets

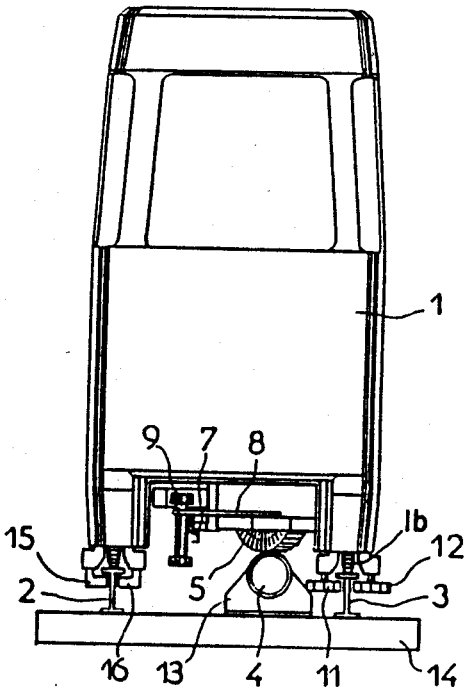
FIG. 5
FIG. 6
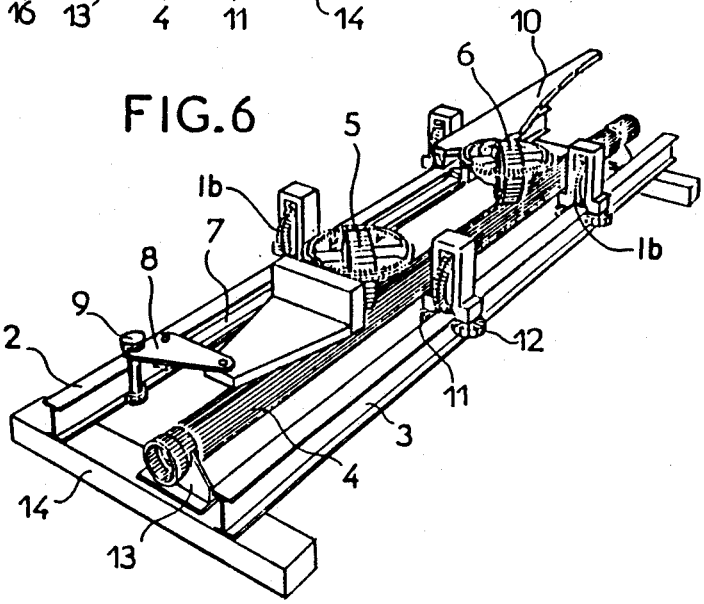

TRANSPORT SYSTEMS USING PASSIVE VEHICLES

The invention is concerned with a transport system using passive vehicles, driven at variable speed by orientable rollers and rotating tubes.

At the present time, short distance individual transport systems using passive vehicles can be broken down into three categories:

Continuous operation systems, mainly constant or variable speed conveyor belts, also referred to as accelerated mobile pavements.

Semi-continuous operation systems, largely derived from a principle developed in mountainous regions and especially in winter sports resorts, which consists mainly of combining continuous (or almost continuous) operation at stops by means of cabins moving at low speed along a platform, with conventional discontinuous operation between stations.

Discontinuous operation systems, including systems using reversible and irreversible vehicles.

These three families of systems are distinguished mainly by: entry and exit times offered to the User, flow capacity, stopping distance, speed, ease with which they can be integrated into an urban environment, possibility of use in conjunction with other existing transport systems, and their cost.

These systems are also distinguished technically by the type of drive; endless cable, belts, linear motor, etc . . . and by their variable speed drive mechanism: deformable links, rotating tubes and pivoting rotating cams, etc . . . .

Short distance semi-continuous transport systems have a relatively low capacity compared with the above-mentioned continuous systems, but they do have the advantage over discontinuous shuttle type systems that the capacity is independent of distance travelled.

From the transport time point of view, semi-continuous systems are slightly better than shuttles operating at maximum speed, since the wait time is independent of the distance travelled.

Consequently, cable systems in which vehicle speed is limit to 10 m/sec are slower than active systems. Therefore, for example, a double shuttle active at 20 m/sec is clearly better than cable systems for distances greater than 600 m.

However, although cable systems have a number of advantages (simplified anti-collision control, simple kinematic chain, . . . ), they have the disadvantage of low speed and also they need several strands and disengageable grips when used on routes with intermediate stations which are not equidistant, and in some circumstances also need a supplementary variable speed drive to obtain a gradual but adequate reduction of velocity when in stations.

There is already one transport system using passive vehicles which uses a drive consisting of rotating tubes and orientable rollers (French patent FR-A-2.036.543). Vehicles are suspended from a monorail and are pulled between stations by a cable at a velocity of about 7 m/sec, and are driven at variable speed in stations by means of a rotating cylinder and orientable roller device which replaces the cable drive to reduce the velocity gradually from 7 m/sec to 0.20 m/sec. Vehicles are attached to the cable through a disengageable grip, with opening controlled by a roller on the vehicle and by a ramp on the edge of the rail in the station. Opening the grip causes rotation of the speed variation device drive roller to ensure that the latter takes over vehicle drive control. The drive roller is realigned when the grip closes again on leaving the station.

This system maintains the cable drive system, and is therefore not suitable for sinuous routes, and requires heavy and expensive foundations.

The purpose of the present invention is to correct these disadvantages. The invention is distinguished in that it solves the problem of creating a transport system using variable speed passive vehicles, either within a site or not, suitable for incorporation into linked networks including sinuous routes, with possibility of intersection, or even integration with other means of transport, and with no constraints on accumulation or spacing of vehicles, fully mechanical deceleration, stop and acceleration in stations, automatic door opening system, safety system acting on the brakes, emergency stop and the possibility of adjusting to suit passenger flow variations.

Systems using the invention are distinguished mainly in that they consist essentially of rotating drive tubes installed along a series of straight lines 39 (FIG. 13) matching the outline of the track, in that the vehicles are fitted with one or more than one pivoting drive rollers in contact with the rotating tubes, and for which the orientation relative to the rotating tubes is controlled by means of an articulated parallelogram linkage including one or more than one cam receiver manoeuver sprocket wheels at the front, in that an accumulation device is fitted on the back of the vehicle chassis to reduce the speed of a vehicle approaching another vehicle until its speed is equal to or less than that of the front vehicle, in that each vehicle is fitted with an emergency brake consisting of a set of jaws 28 (shown schematically FIGS. 2–4) which grip the rolling rail in the case of an emergency, in that the access doors 29 (controlled from the platform by cams 20—FIG. 8) open to hide the free space between two vehicles, in that the direction of travel at the end of the line is reversed by means of a rotating table 30 (FIG. 12) including two track elements 31, 32 symmetrically located about the axis of rotation 33 of the table or by a cam 17 built into an end stop 18 to reverse the tube-roller device pitch, in that switches comprise mobile track elements 34, 35 (FIG. 13) with minimum discontinuity necessary for transfer, in that the rotating tubes are protected by plates 23 (FIG. 9) at level crossings 42, in that vehicle doors 29 gradually open and close in stations, with safety at the access platform 21 (FIG. 8) controlling a complete stop and restarting controlled from the central monitoring station.

Tube rotation is controlled individually or collectively by means of motors 38 built into the track. Collective drive on some tube sections makes use of universal joints 36 (FIG. 13) or flexible shafts connecting adjacent tube sections. Rotation drive makes use of a notched belt 37 fitted in a notched throat 41 (FIG. 10) whose depth matches the thickness of the belt. The power and speed of the motors 38 driving the rotating tubes are determined as a function of the relief and special characteristics of the route. Motors located at crossings are controlled by traffic lights 25 (FIG. 19) or other similar devices.

The accumulation device reduces the speed of a vehicle when it approaches the vehicle in front, and comprises a tail with a progressively sloping ramp and which acts on the orientable articulated parallelogram manoeuver sprocket wheel on the approaching vehicle pivoting drive rollers.

The purpose of the jaws 28 is to grip one of the roller rails in case of emergency. They are actuated by springs controlled by a pressurized gas trigger 28' (shown schematically FIG. 4) which can also be manually actuated, or automatically by the front buffers.

One of the cam receiver rollers on the front of the articulated parallelogram linkage juts out in front of the chassis by a distance adequate to stop the drive and apply the vehicle brakes if there is a frontal shock.

The travel direction reversal cam 17 at the end of the line is fixed to an end stop 18 similar to the tail of the accumulation device, and puts the orientable drive rollers into the neutral position and then reverses their inclination, by acting on one of the rollers at the front of the orientable drive roller control parallelogram linkage.

The periphery of the pivoting drive rollers is coated with a bandage of material conducive to adherence and reduction of roller noise. Using the preferred fabrication method, this material will be polyurethane.

The vehicle is guided laterally by rollers at both sides of the waist of one of the rails.

The advantages obtained from this invention consist mainly in that drive energy is distributed throughout the length of the route in the form of rotating tubes at ground level, in that individual vehicle safety stops are possible, that level crossings with other lines or other means of transport are possible, that each vehicle is independent within mandatory constraints, that there is no on-board energy, that vehicles cannot collide and that they can accumulate and reverse direction smoothly, that the speed and power transmitted to the tube sections is adjusted as a function of the route, that the operating noise level is very low, that the track footprint is minimized, that gradients of 15% can be mounted, that the radius of curvature of the track can be as low as 10 m, that a linked network structure is possible, that vehicles can bunch together safely and without jerks, giving the impression of a long train at peak hours, that operations can be modified at off-peak hours with vehicles systematically stopping in stations, that there are no constraints on station layout, that the hourly flow is about 400–500 passengers in each direction, that the velocity can reach 10 m/sec, and that the time required for getting on and off the vehicle is between 10 and 20 seconds.

Other characteristics and advantages will be brought out in the following description of a passenger transport system using passive vehicles supported on rails, driven at variable speed by rotating tubes and orientable rollers, given as a non-restrictive example in conjunction with the attached figures on which:

FIG. 5 shows a front view of a vehicle in place on the track,

FIG. 6 shows a perspective view of the drive mechanism.

Figure 1:
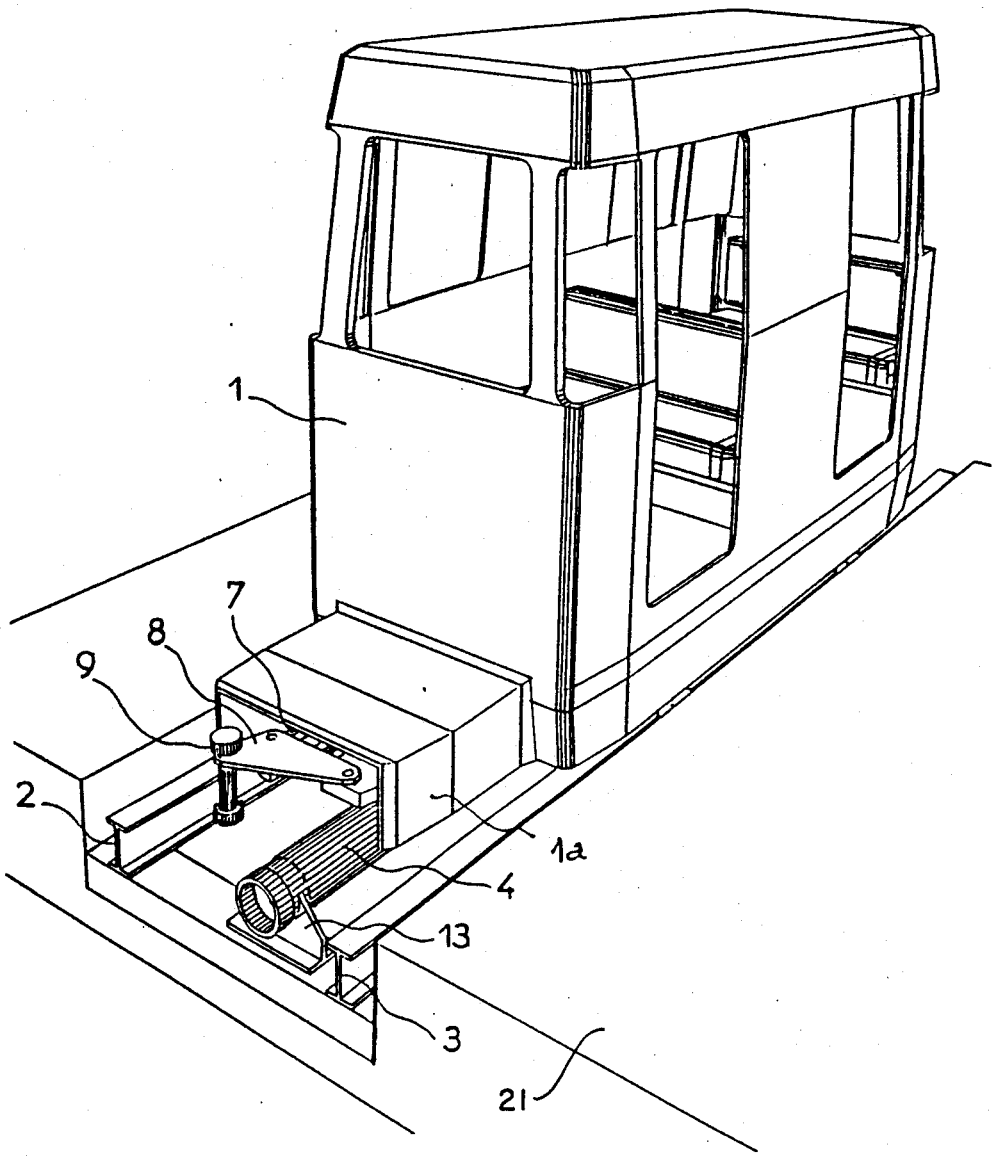
FIG. 1 shows a perspective view of a vehicle in place on the track.
Figure 2:
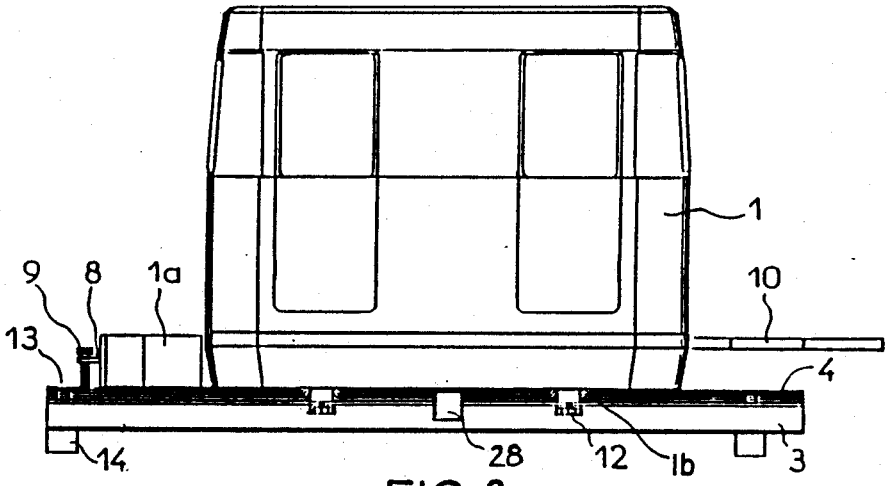
FIG. 2 shows a side view of a vehicle in place on the track.
Figure 3:
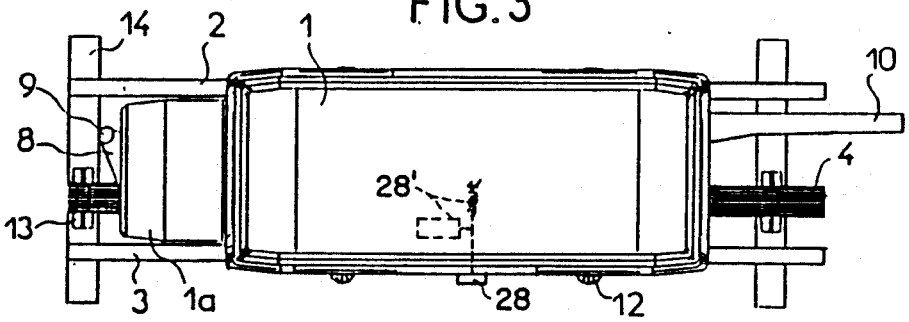
FIG. 3 shows a top view of a vehicle in place on the track.
Figure 4:
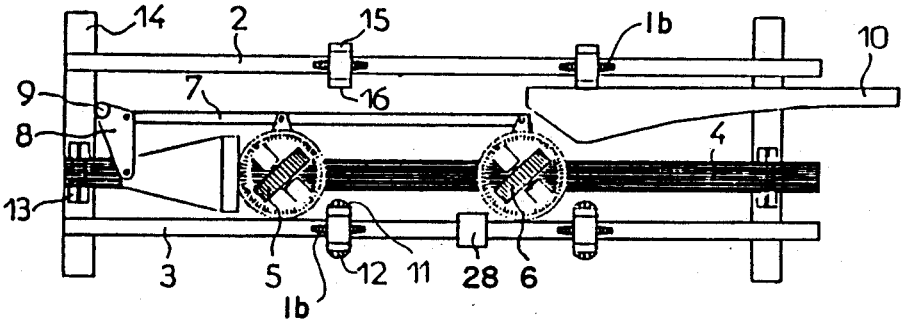
FIG. 4 shows a view of the drive train mechanism from above.
Figure 7:
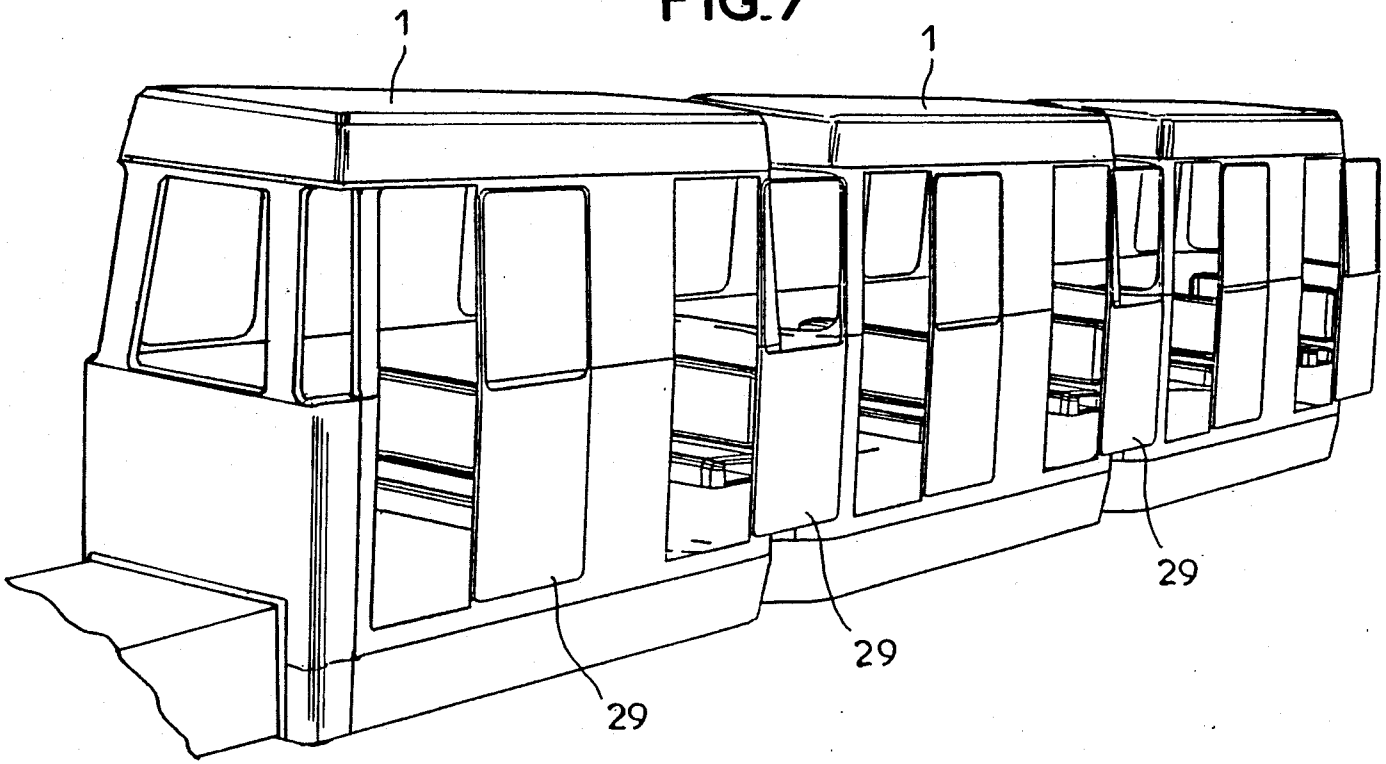
FIG. 7 shows a perspective view of three vehicles in station, doors open.

The figures show a transport system with passive vehicles driven at variable speed by rotating tubes and orientable rollers, consisting essentially of a vehicle 1 having wheels **1*b* riding on rails 2 and 3 and driven by means of tubes 4 rotating in fixed bearings 13 and engaging drive rollers 5 and 6 carried by the vehicle wich can be oriented by means of a articulated parallelogram linkage which includes a lever 8 with a manoeuvring sprocket wheel or cam follower 9 at its free end controlled by fixed cams located at the edge of the track or by the ramp tail or cam 10 at the back of the vehicle in front. The vehicles 1 are guided laterally by rollers 11 and 12 located on each side of the waist of one of the rails 3, attached to cross-bars 14, and firmly kept in place vertically above the rails 2 and 3 by means of rollers 11 and 12 and brackets 15 and 16 located on each side of the waist of the other rail 2**.

In accordance with this invention, the vehicles are supported on the track made up of rails 2 and 3, and they are guided relative to one of these rails by means of rollers 11 and 12 located on each side of the waist of one of the rails 3, and on which they are maintained vertical by rollers 11 and 12 and brackets 15 and 16 which project under rail 2 and 3 roller flanges; this eliminates the possibility of vehicles tipping over under any applied forces.

The vehicles are driven by means of tubes 4 rotating in bearings 13 attached to cross-bars 14, and rollers 5 and 6, rigidly connected for rotation, and whose inclination relative to rotating tubes 4 is determined as a function of the required displacement velocity.

The articulated parallelogram linkage 7 pivots the drive rollers and can be used (by acting on lever 8 of the manoeuvring sprocket wheel 9) to obtain the various settings of the drive rollers, for example, for disengaging the drive; in this case rollers 5 and 6 are oriented cross-wise relative to tubes 4. Various drive speeds can be obtained in this manner, or the vehicle can be stopped on the track; in the latter case, rollers 5 and 6 are perpendicular to tube 4, or the direction of vehicle motion is reversed when this position is exceeded and rollers 5 and 6 are oriented symmetrically relative to their initial positions.

The manoeuvring sprocket wheel 9 on lever 8 of the articulated parallelogram linkage control 7 is brought into use when the vehicle catches up with the vehicle in front, since the leading vehicle ramp tail 10 goes under the chassis and progressively bears on the cam follower 9 on lever 8 until the velocity of the two vehicles is synchronized.

When the front of a vehicle bumps into an obstacle, the manoeuvring sprocket wheel 9 which juts out in front of the vehicle buffers **1*a*, pivots lever 8 towards the back of the chassis; the effect of this is to orientate drive roller 5 and 6** perpendicular to the tube and therefore to remove drive power.

A cam 17 with a progressively increasing slope with a suitable predetermined profile can be installed on an end-stop at the end of the line or at any required location on the track, in order to stop and reverse the direction of vehicle motion, making use of manoeuvring sprocket wheel 9. It is also possible, by remotely changing the active length of the removable cam 17 with gradually varying slope installed on the track or in front of an end stop, to store vehicles at the end of the line or on a garage track, and then to have them return to a determined location by reversing the direction of the drive system pitch. The vehicle at the front will then act as a pusher for previously made-up multiple units.

Figure 8:
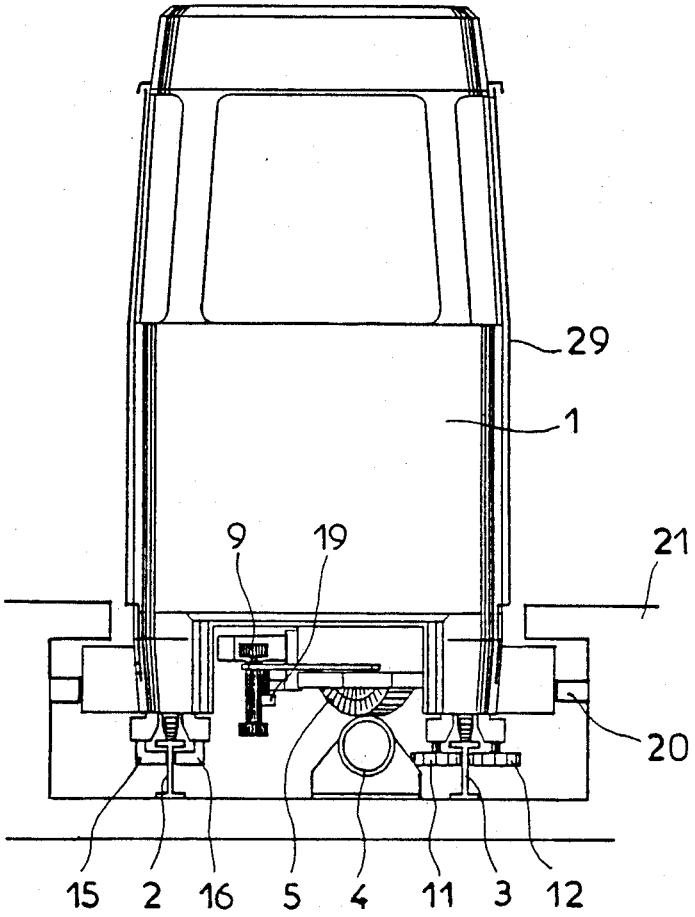
FIG. 8 shows a front view of a vehicle in station, doors open.
Figure 9:
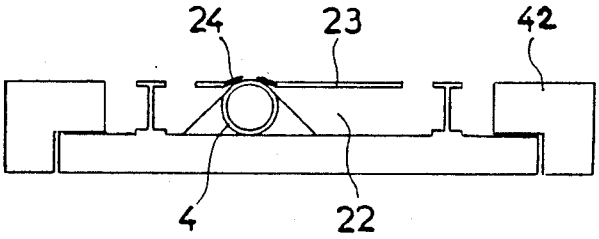
FIG. 9 shows a cross section of the track in passenger crossing areas.

Stations are laid out along the track, and include deceleration and possibly stop cams 19 (FIG. 8). These cams gradually incline drive rollers 5 and 6, until the speed is sufficiently reduced to allow passengers to get on and off the vehicle. This speed is mechanically adjustable depending on operating constraints.

When the speed is low enough, the doors are opened by means of a cam 20 (FIG. 8) along the platform 21. Vehicles travel at low speed in the station, which is big enough to contain 3 or 4 vehicles simultaneously. Doors are closed at the end of the platform by means of another cam. Closing is controlled by an end of travel detector. The vehicle can then pick up speed again, depending on the profile of the cam located at the exit from the station.

Each station is equipped with a remote television monitoring installation, which allows remote resetting of the cabin door open and complete stop trigger safety feature, to facilitate getting on the vehicle.

In passenger crossing areas, the track is filled in using plates 23 so that only the top part of the tracks 2, 3 is visible. The vehicle is guided on its track under the plates 23. In those areas the rotating tubes 4 are slightly raised to ensure adequate contact with the drive rollers. This is achieved by the use of lips 24 on each side of the tube, or by machining a series of notches in the tube, in which the teeth of a rake engage to obtain a safety level similar to that presently existing on mechanical escalators. This part of the rotating tube is reinforced to allow passage of automobile vehicles without risk of damage.

Vehicle velocity is reduced when approaching crossings for safety purposes. Authorization for vehicle passage depends on external information and on a free passage detection device.

Figure 10:
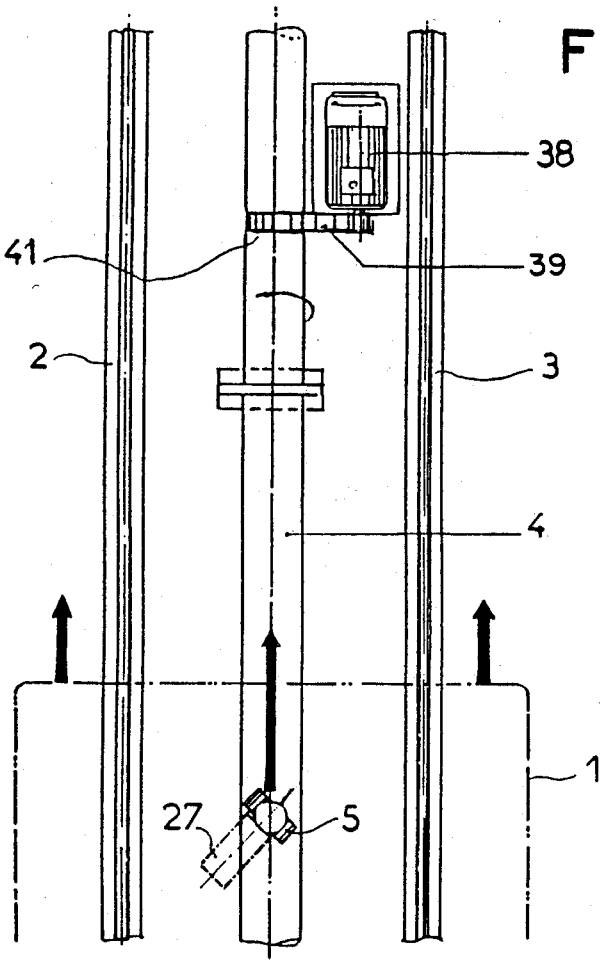
FIG. 10 shows a top view of the track with motor driving of the rotating tube.
Figure 11:
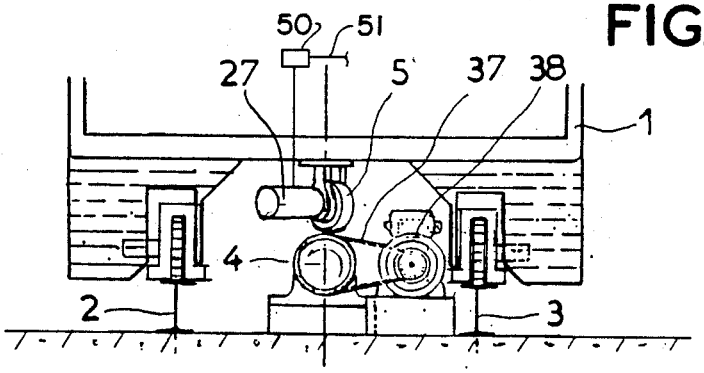
FIG. 11 shows a cross section of the lower end of a vehicle in place on the track with dynamo and motor driving of the rotating tube.
Figure 12:
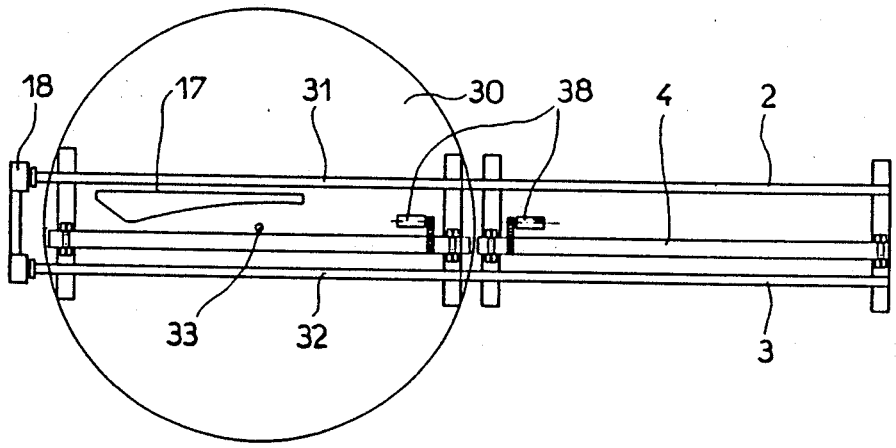
FIG. 12 shows a top view of rotating table for travel direction reversing.
Figure 13:
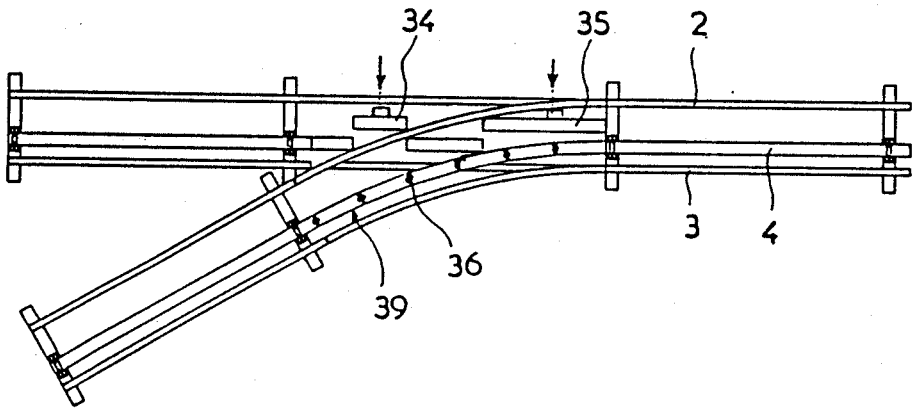
FIG. 13 shows a top view of switches.
Figure 14:
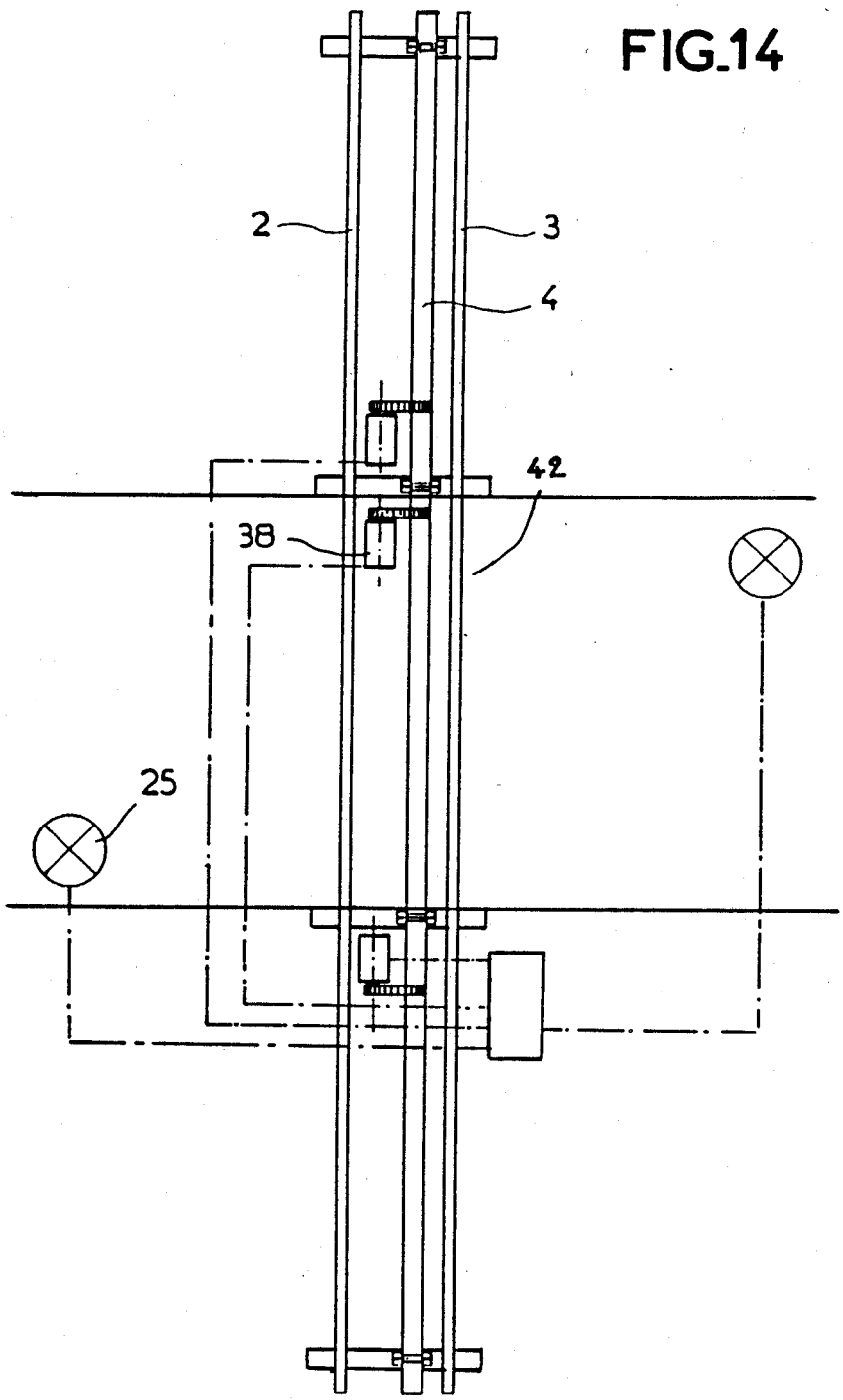
FIG. 14 shows a top view of crossing areas.

One of the pivoting drive rollers 5 and 6 on each vehicle drives a dynamo 27 (FIGS. 10, 11) which charges a set of on-board accumulators 50 supplying the onboard electrical circuit 51; this allows, for example, independent signalling and sound systems.

The track can be supported on an overhead structure to cross over other works or to free occupied ground surface. The vehicle can be suspended for the same purpose.

The track can have a radius of curvature of as little at 10 meters.

Vehicle flow can be intermittent, constant or flexible, depending on passenger flow. Flow management is handled taking account of the number of passengers on-board determined by validation of access tickets or checking magnetic transport cards.

Remote control, remote checking and transmissions make use of a fiber optic link and automatically controlled processors.

The system using the invention is intended mainly for transportation of persons already within a site, and not for connections of the type suburb/downtown or suburb/suburb, connecting together central sites and activity centers within towns, extension of urban lines when it can be in the form of a bipolar junction between a regional express network station and a concentrated activity center, particularly in new urban developments; collection in residential areas to collective transportation terminals; internal connections within exhibition centers, industrial sites, large shopping centers and for transport of materials and products.

We claim:

1. Transport system using passive wheeled vehicles riding on rails which define a track and driven at variable speed by rotating tubes extending along and between the rails and engaging at least one pivoting drive roller carried by each vehicle and whose orientation relative to said tubes is varied by an articulated parallelogram linkage including at least one cam follower at the front of the vehicle, distinguished in that:

- each vehicle includes a rearward projecting cam engageable by the follower of an approaching vehicle so that the velocity of the approaching vehicle can be gradually reduced until it is practically equal to that of the vehicle being caught up;
- each vehicle carries anti-overturning means engaging the rails and an emergency brake consisting of a pair of jaws intended to grab one of the rails;
- access doors controlled by a cam at a station to open to hide the gap between two adjacent vehicles;
- reverse motion of the vehicles is obtained at the end of the line by a rotating table including two track elements symmetrically laid out relative to the axis of rotation of the table;
- switches consist of mobile track components which guarantee the necessary direction change for a transfer but have as little discontinuity as possible;
- the rotating tubes are protected by a rake at level crossings;
- the radius of curvature of the track can be as little as 10 m;
- the rotating tubes in some sections of the track are connected by universal joints or flexible shafts and only one such tube is driven by a motor;
- the tubes are driven by a notched belt installed in a notched throat whose depth matches the belt thickness;
- the drive motor power and speed are determined as functions of the relief and other special features of the route;
- one of the drive rollers on each vehicle drives a dynamo to charge a set of on-board accumulators used to provide power for the on-board electrical circuits; and
- vehicle flow can be intermittent, constant or flexible depending on passenger flow.

2. Transport system in accordance with claim 1 wherein the anti-overturning means comprises two rollers on opposite sides of one of the rails to provide lateral support and two brackets on opposite sides of the other rail and projecting under the rail top flange.

3. Transport system in accordance with claim 1 wherein the rotating tube drive motors located at intersections with another traffic route, are controlled by crossing lights or similar devices.

4. Transport system in accordance with claim 1 wherein the rearward projecting cam comprises a tail which includes a ramp of gradually varying slope which engages the follower on the approaching vehicle.

5. Transport system in accordance with claim 1 the jaws which are intended to grip the rails in case of emergency are actuated by springs which are freed by a pressurized gas activator trigger, either manually or automatically.

6. Transport system in accordance with claim 1 wherein the linkage juts out on the front of the vehicle enough so that the vehicle itself will be stopped and its drive will be disengaged if it bumps against an obstacle in front.

7. Transport system in accordance with claim 1 wherein the pivoting drive rollers are coated with a material conducive to good adherence on the rotating tubes, and also to noise reduction.

8. Transport system in accordance with claim 7 wherein the material is polyurethane.

9. Transport system in accordance with claim 1 wherein the vehicles are fitted with doors which open and close gradually under the control of fixed cam means at stations and including other fixed cam means at stations engageable by the cam follower to insure a complete stop of the vehicle and a central monitoring station having means to restart a stopped vehicle.

10. Transport system in accordance with claim 1 wherein stopping the vehicle and reversing its direction at the end of the line makes use of a remotely controlled cam of progressively varying slope and variable length installed in front of such end.

11. Transport system in accordance with claim 1 including remote control means, remote inspection means and transmission means comprising fiber optic connections and automatically controlled processors.

12. Transport system in accordance with claim 11, including vehicle flow management means comprising means for counting the number of passengers on the vehicle, by validating access tickets or checking magnetic transport cards.

* * * * *